US007503390B2

(12) United States Patent
Gomez

(10) Patent No.: US 7,503,390 B2
(45) Date of Patent: Mar. 17, 2009

(54) LOCK MECHANISM FOR A SLIDING SLEEVE

(75) Inventor: Alfredo Gomez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 328 days.

(21) Appl. No.: 11/001,977

(22) Filed: Dec. 2, 2004

(65) Prior Publication Data

US 2005/0126787 A1 Jun. 16, 2005

Related U.S. Application Data

(60) Provisional application No. 60/528,688, filed on Dec. 11, 2003.

(51) Int. Cl.
*E21B 34/10* (2006.01)

(52) U.S. Cl. ..... 166/323; 166/237

(58) Field of Classification Search ..... 166/323, 166/317, 237
See application file for complete search history.

(56) References Cited

U.S. PATENT DOCUMENTS

| | | | | |
|---|---|---|---|---|
| 3,831,632 | A | 8/1974 | Young | |
| 4,441,559 | A * | 4/1984 | Evans et al. | 166/382 |
| 4,457,368 | A | 7/1984 | Knierimen et al. | |
| 4,510,995 | A | 4/1985 | Krause, Jr. et al. | |
| 4,823,872 | A | 4/1989 | Hopmann | |
| 5,156,220 | A | 10/1992 | Forehand et al. | |
| 5,174,379 | A | 12/1992 | Whiteley et al. | |
| 5,413,180 | A | 5/1995 | Ross et al. | |
| 5,609,204 | A | 3/1997 | Rebardi et al. | |
| 5,692,564 | A * | 12/1997 | Brooks | 166/127 |
| 5,810,082 | A * | 9/1998 | Jordan, Jr. | 166/120 |
| 5,819,854 | A * | 10/1998 | Doane et al. | 166/373 |
| 5,865,251 | A | 2/1999 | Repardi et al. | |
| 6,059,041 | A | 5/2000 | Scott | |
| 6,148,919 | A * | 11/2000 | Burris et al. | 166/319 |
| 6,230,801 | B1 | 5/2001 | Hill, Jr. et al. | |
| 6,230,811 | B1 | 5/2001 | Ringgenberg et al. | |
| 6,237,687 | B1 | 5/2001 | Barbee, Jr. et al. | |
| 6,253,861 | B1 | 7/2001 | Carmichael et al. | |
| 6,260,616 | B1 | 7/2001 | Carmody et al. | |
| 6,405,800 | B1 | 6/2002 | Walker et al. | |
| 6,466,729 | B1 | 10/2002 | Wagoner et al. | |
| 6,578,638 | B2 * | 6/2003 | Guillory et al. | 166/387 |
| 6,609,569 | B2 | 8/2003 | Howlett et al. | |
| 2002/0148610 | A1 | 10/2002 | Bussear et al. | |

OTHER PUBLICATIONS

Osca Technical Bulletin, "The ISO System," 1 page, 2000.
Osca Technical Bulletin, "Pressure Actuated Circulating Valve," 1 page, 2000.

* cited by examiner

*Primary Examiner*—William P Neuder
(74) *Attorney, Agent, or Firm*—Steve Rosenblatt

(57) ABSTRACT

A locking device prevents stressing of other components used to hold tool portions against relative movement until a desired location is reached. A locking dog holds a first component, such as a sliding sleeve to a second component, such as a mandrel until pressure can move a piston and remove support for the dog. The same pressure that removes support for the dog to unlock the lock also forces a retainer, such as a shear pin that holds a sleeve to break to allow the sleeve to shift. The locking dog keeps stress off the shear pin when the locking dog is supported in the run in configuration. An alternative design uses a grease filled cavity to dampen shocks that could load a shear pin to the point of failure.

20 Claims, 4 Drawing Sheets

LOCK MECHANISM FOR A SLIDING SLEEVE

PRIORITY INFORMATION

This application claims the benefit of U.S. Provisional Application No. 60/528,688, filed on Dec. 11, 2003.

FIELD OF THE INVENTION

The field of this invention is lock devices that selectively prevent relative movement between two downhole components until a predetermined condition is met and the device is defeated to allow relative movement.

BACKGROUND OF THE INVENTION

Many downhole applications require adjacent components to remain in a fixed relationship during run in. In many cases, shear pins or other temporary restraints are employed to break away under an applied force. While in many situations such arrangements work reasonably well, there can be situations during run in that could trigger a premature failure of the shear locking mechanism. Such early and unintended release of a shear retainer could have the result of an inability to set the tool or operate the tool where needed. It has been learned that in some applications, the process of running a tool into the desired location can put cyclical stresses on shear pins so as to cause them to fail prematurely.

The desire to prevent premature shear pin failure has brought about the solution offered by the present invention. The problem that lead to the present invention was first noticed in a product called CMP Defender®, which is a product made by Baker Hughes and features a mandrel and an interior sliding sleeve. This tool was described in U.S. application Ser. No. 10/408,798 filed on Apr. 7, 2003, whose contents are fully incorporated herein as if fully set forth. It also has an exterior sliding sleeve that is covering a port in the mandrel during run in. The interior sleeve is in the open position for run in. Pressurizing the tubing sets the packer, which can be connected to this tool. After sufficient pressure is developed, the packer sets. The application of pressure shifts the outer sleeve down to still leave the mandrel port closed as long as pressure that set the packer is maintained. However, the initial pressurizing that shifts the outer sleeve down breaks a shear pin that held it fixed for run in. When the packer setting pressure is removed, a spring moves the outer sleeve uphole to open the mandrel port.

The problem with this design was that during run in the string is lowered and brought to an abrupt stop to add new tubing at the surface. The abrupt change in direction caused the outer sleeve to stress the shear pins and created a potential that the shear pin could prematurely fail before the packer was delivered to its intended location.

Various solutions were devised and described below. Those skilled in the art will realize that the solutions are adaptable to other devices than the tool described. Sliding sleeve valves have long been known in the art as illustrated in U.S. Pat. Nos. 5,156,220 and 6,260,616 . Locking devices involving dogs extending into grooves and supported to lock one body to another are illustrated in U.S. Pat. No. 4,510,995 and 4,823,872 . Those skilled in the art will appreciate the various solutions offered by the present invention to address the issue of stressing the retaining mechanism during run in so that the components will remain in position until relative movement is needed to set the tool, from a review of the description of the various embodiments, the drawings and the claims, which appear below.

SUMMARY OF THE INVENTION

A locking device prevents stressing of other components used to hold tool portions against relative movement until a desired location is reached. A locking dog holds a first component, such as a sliding sleeve to a second component, such as a mandrel until pressure can move a piston and remove support for the dog. The same pressure that removes support for the dog to unlock the lock also forces a retainer, such as a shear pin that holds a sleeve to break to allow the sleeve to shift. The locking dog keeps stress off the shear pin when the locking dog is supported in the run in configuration. An alternative design uses a grease filled cavity to dampen shocks that could load a shear pin to the point of failure.

DETAILED DESCRIPTION OF THE PREFERRED EMBODIMENT

Figure 1:
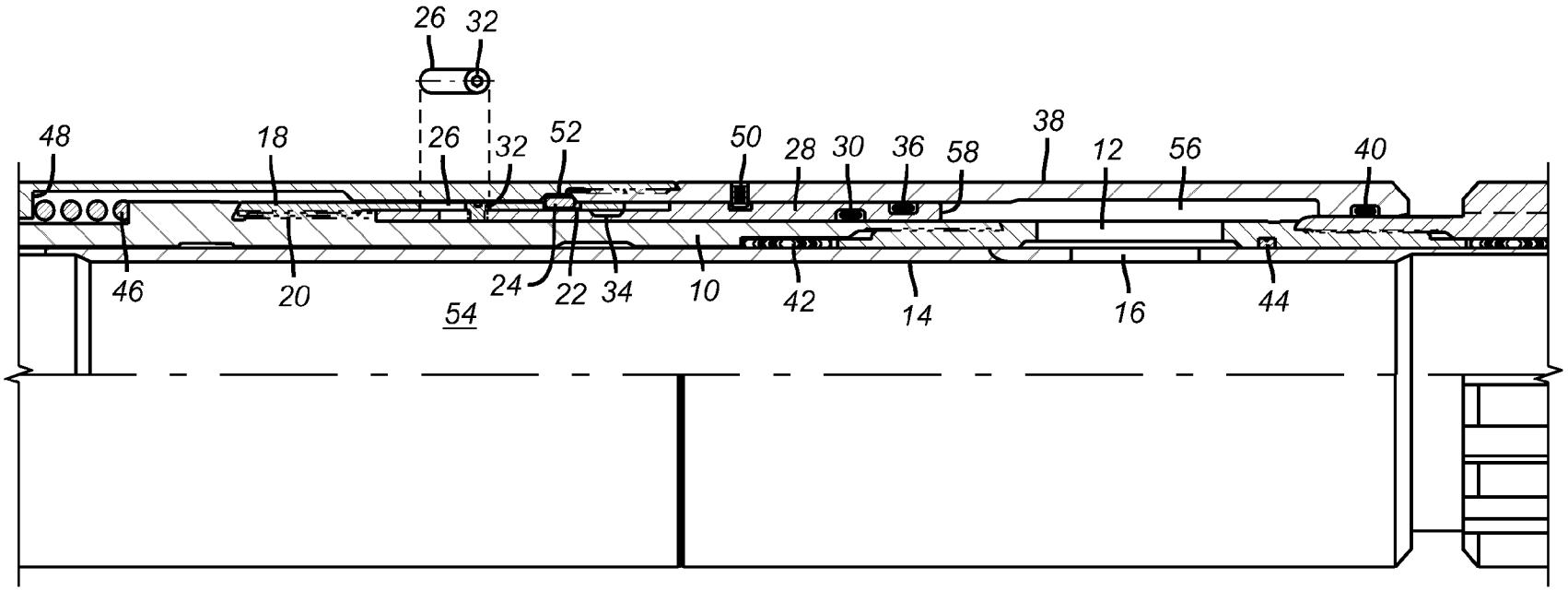
FIG. 1 is a section view in the run in position showing the dog holding the outer sleeve in a locked position.

The preferred embodiment will be illustrated in the context of a tool that includes a pressure set packer in combination with a sliding sleeve assembly. As seen in FIG. 1, the mandrel 10 has a port 12. Mandrel 10 can be mounted below the packer, which is not shown. An internal sleeve 14 has a port 16 that is in alignment with port 12 of mandrel 10 for run in. A dog retainer 18 is secured to mandrel 10 at thread 20. Dog retainer 18 has a window 22 in which sits a dog 24. Those skilled in the art will appreciate that alternatives to the dog 24 could be employed, such a collets or a c-ring, to name a few examples. Dog retainer 18 has a second window 26. Piston 28 is mounted over mandrel 10 with seal 30 in between. A screw 32 is attached to piston 28 and extends into window 26 of the dog retainer 18. Piston 28 has a groove 34 that allows the dog 24 to become unsupported when the groove 34 is brought into alignment with it, as will be explained below. Piston 28 also has a seal 36 to contact the outer sleeve 38 that is mounted over it. Outer sleeve 38 has a seal 40 to contact mandrel 10 below port 12. Between the internal sleeve 14 and the mandrel 10 are seals 42 and 44 disposed respectively on opposite sides of port 12 on the mandrel 10. Seal 42 is shown as opposed stacks of chevron seals but can be any type of seal without departing from the invention. Spring 46 puts an uphole bias on outer sleeve 38 at shoulder 48. A shear pin 50 secures outer sleeve 38 to piston 28.

Figure 2:
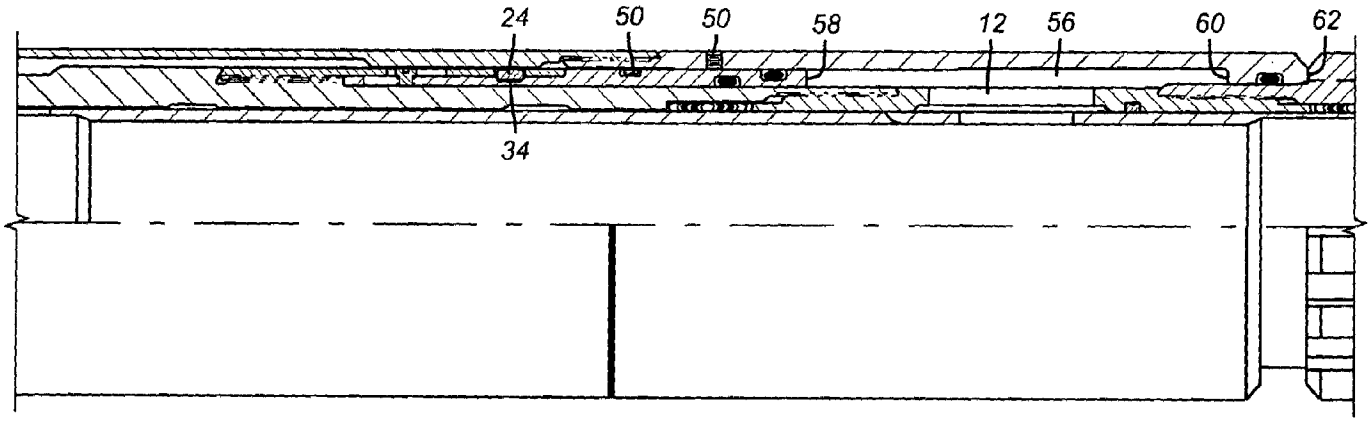
FIG. 2 is the view of FIG. 1 showing the dog in an unsupported position and the shear pin holding the outer sleeve broken and the port in the mandrel still closed due to pressure continuing to be applied.

Those skilled in the art will appreciate that shear pin 50 is prevented from being stressed during run in because the dog 24 supported by piston 28 extends through window 22 and into groove 52 of outer sleeve 38 to prevent the outer sleeve from moving up or down. The central passage 54 through mandrel 10 is in fluid communication with annular space 56 because the port 16 in internal sleeve 14 aligns with port 12 of mandrel 10. When the tool is in the desired location, pressure is brought to bear in passage 54 and it communicates with annular space 56. The pressure in annular space 56 acts on surface 58 of piston 28 to push it uphole and break the shear pin 50. Movement of the piston 28 brings groove 34 into alignment with dog 24 to undermine support for it. Piston 28 can move up because the screw 32 can only move uphole in window 26. The dog 24 moves toward mandrel 10 in a radial direction to allow the outer sleeve 38 to move downwardly, in the opposite direction than piston 28. The pressure in annular space 56 acts on surface 60 to move the outer sleeve down against shoulder 62, as shown in FIG. 2. If the pressure is maintained, the port 12 in mandrel 10 continues to be obstructed to allow the retained pressure to be used to set the packer (not shown).

At some point, the packer is set and the pressure in passage 54 is released. At that time, the spring 46, shown in FIG. 1 can push the outer sleeve 38 up far enough to get seal 40 past port 12 to allow access to the formation through port 12 into passage 54 and through the packer (not shown).

Figure 4:
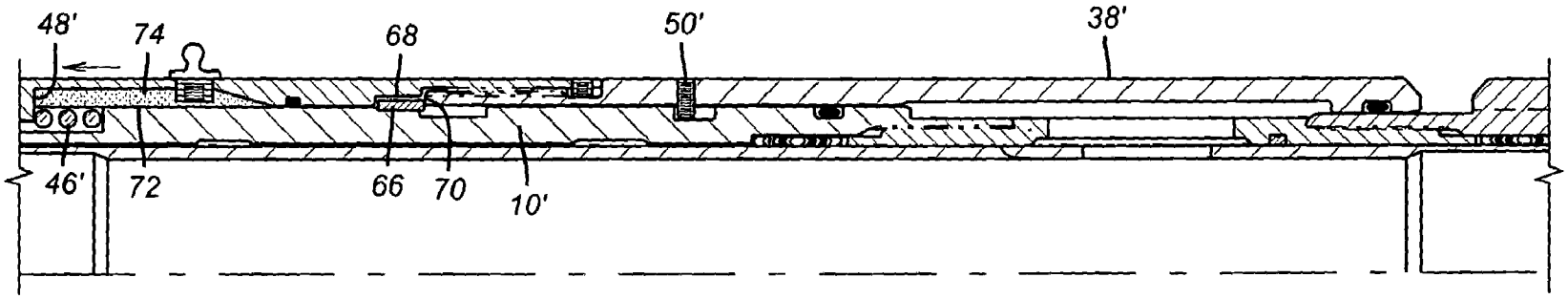
FIG. 4 is a section view in the run in position of an alternate embodiment showing a c-ring to prevent movement in one direction during run in and a cavity to damp movements in an opposite direction.

FIG. 4 shows a different solution. The shear pin 50' is in a wide groove 64. A split or c-ring 66 is in groove 68 in outer sleeve 38'. Shoulder 70 on outer sleeve 38' engages the c-ring 66 to prevent the outer sleeve 38' from moving uphole. As before spring 46' acts on shoulder 48' to push outer sleeve 38' in the uphole direction. If during run in a sudden stopping of the mandrel 10' creates momentum trying to push the outer sleeve 38' downhole, such movement is allowed but damped due to the cavity 72 being filled with viscous grease or the like 74. The wide groove 64 allows the shear pin 50' to move down to some extent without engaging the end of groove 64 so as to avoid stressing the shear pin 50' due to some degree of movement.

Figure 5:
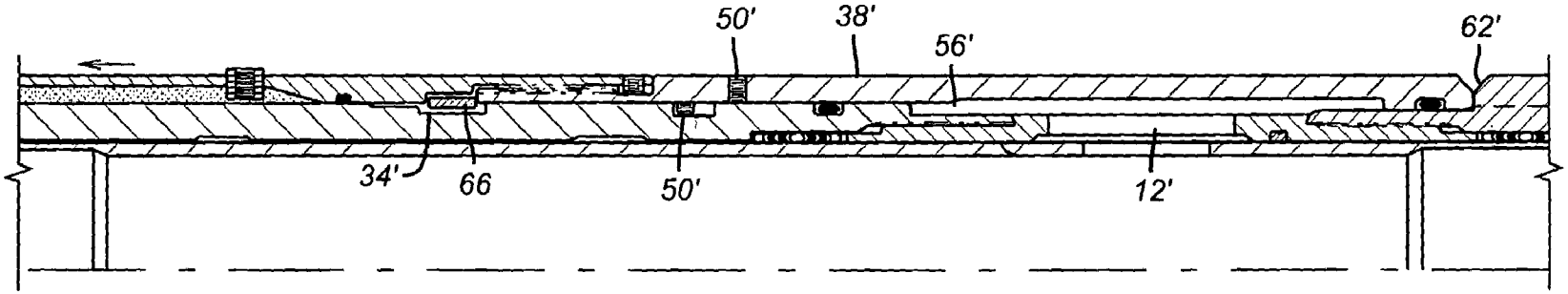
FIG. 5 is the view of FIG. 4 with pressure applied to break the shear pin.

As shown in FIG. 5, when pressure is applied into annular space 56' through port 12', the outer sleeve 38' is pushed against shoulder 62' as shear pin 50' is broken. The c-ring 66 is displaced into alignment with groove 34' and snaps radially inwardly to get out of the way.

Figure 6:
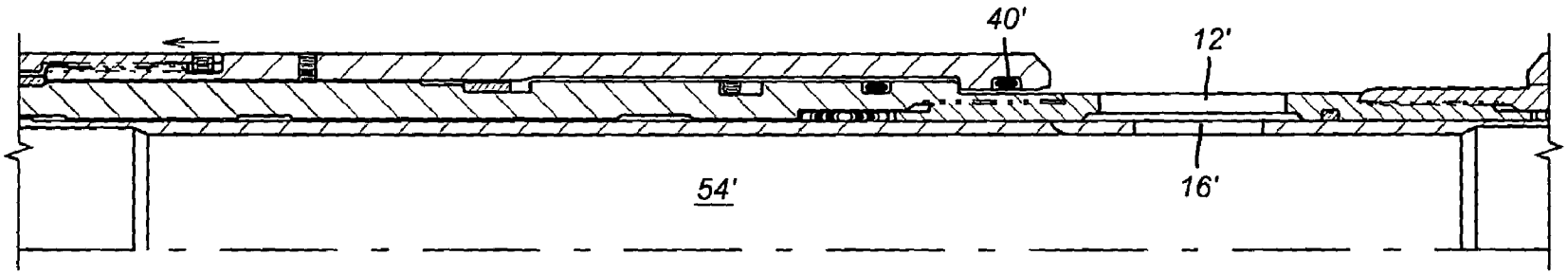
FIG. 6 is the view of FIG. 5 with the applied pressure removed.

As shown in FIG. 6, when the pressure is released, spring 46' pushes seal 40' of outer sleeve 38' above port 12' to allow flow communication from the formation through ports 12' and 16' and into passage 54'.

Figure 3:
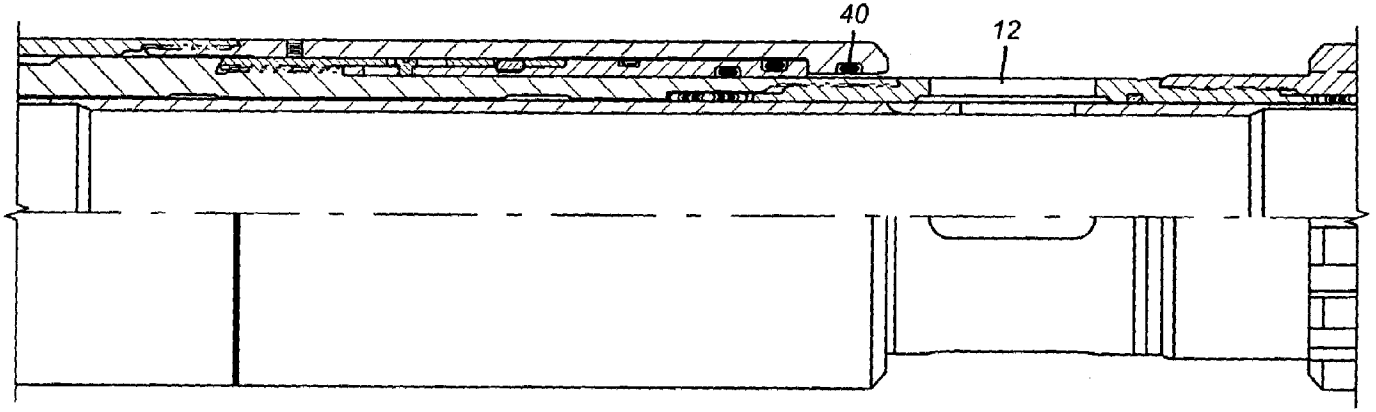
FIG. 3 is the view of FIG. 2 with the pressure removed and a spring shifting the outer sleeve to provide access to the mandrel port.

Those skilled in the art will appreciate that the preferred embodiment of the invention, shown in FIGS. 1-3 fixed an outer component during run in against forces that can act on it and in so doing prevents any retaining device on that component from getting stressed to the point of premature failure. In the specific tool illustrated, failure of shear pin 50 or an equivalent device at an inopportune time would allow spring 46 to shift outer sleeve 38 to open port 12 and thus prevent the use of pressure buildup in passage 54 from actuating the packer (not shown). Instead, the outer sleeve 38 is fixed and a pressure buildup in passage 54 will first push piston 28 so that dog 24 is undermined. As that point the applied pressure will also move the outer sleeve 38 downwardly in the opposite direction from the movement of piston 28. With port 12 still covered the pressure built up can set the tool, in this case a packer. Backing the applied pressure off allows spring 46 to shift outer sleeve 38 to expose port 12 for production.

The solution in FIGS. 4-6 only prevents movement of sleeve 38' in an uphole direction using the c-ring 66. Allowances are made to let the outer sleeve 38' move down somewhat by virtue of the wide groove 64 preventing the shear pin 50' from hitting one of its edges, if the movement is minimized. To help minimize movement in the downhole direction of outer sleeve 38' the cavity 72 is filled with viscous grease or the like that must be displaced through small exit paths so as to damp or resist the tendency of the outer sleeve 38' to shift in a downhole direction during run in.

The invention has broader application and can be used to hold one member locked against another to protect so other retaining device against loading during run in that could cause premature movement of the retained member preventing the tool in question from being properly operated.

The foregoing disclosure and description of the invention are illustrative and explanatory thereof, and various changes in the size, shape and materials, as well as in the details of the illustrated construction, may be made without departing from the spirit of the invention.

I claim:

1. A lock mechanism in a single downhole tool, comprising:

a mandrel;

a movable member selectively retained in a first position to said mandrel by a removable member;

a lock to selectively prevent application of mechanical force applied to said mandrel in opposed directions or to said movable member to reach said removable member;

said movable member continuing to be retained to said mandrel when allowed to move to a second position when said lock permits force to be applied to said removable member.

2. The mechanism of claim 1, wherein:

said lock limits said movable member from moving with respect to said mandrel in at least one direction.

3. The mechanism of claim 2, wherein:

said lock limits said movable member from moving with respect to said mandrel in two opposed directions.

4. The mechanism of claim 2, wherein:

said lock permits movement of said movable member with respect to said mandrel of predetermined distance.

5. A lock mechanism in a single downhole tool, comprising:

a mandrel;

a movable member selectively retained in a first position to said mandrel by a removable member;

a lock to selectively prevent application of force applied to said mandrel in opposed directions to reach said removable member;

said movable member continuing to be retained to said mandrel when allowed to move to a second position when said lock permits force to be applied to said removable member;

said lock limits said movable member from moving with respect to said mandrel in at least one direction;

said lock permits movement of said movable member with respect to said mandrel of predetermined distance;

said lock comprises an elongated recess of said mandrel, said removable member extending into said recess and remaining in tact for said predetermined distance of relative movement between said movable member and said mandrel.

6. The mechanism of claim 5, wherein:

said recess is occupied with a material to retard movement of said removable member in said recess.

7. The mechanism of claim 6, wherein:

said material comprises viscous grease.

8. A lock mechanism for a downhole tool, comprising:

a mandrel;

a movable member selectively retained to said mandrel by a removable member;

a lock to selectively prevent application of force to said removable member;

a port in said mandrel communicating with a sealed annular space between said mandrel and said movable member;

said movable member actuated in a first direction by pressure through said port into said annular space for defeating said removable member;

said mandrel further comprising a biasing member acting on said movable member, upon removal of pressure to said sealed annular space, to bias said movable member in a second direction opposite said first direction to a position exposing said port.

9. The mechanism of claim 8, further comprising;

a piston disposed between said mandrel and said movable member and responsive to pressure applied in said annular space;

said removable member comprises at least one pin extending into said piston and said movable member;

said lock comprises at least one dog selectively retaining said movable member to said piston;

whereupon movement of said piston responsive to pressure in said annular space breaks said pin and then removes said dog from said movable member.

10. The mechanism of claim 9, further comprising;

a recess in said piston, said recess coming into alignment with said dog, upon movement of said piston, to release said movable member from said piston.

11. The mechanism of claim 8, wherein;

said lock permits movement of said movable member with respect to said mandrel of predetermined distance.

12. The mechanism of claim 11, wherein;

said lock comprises an elongated recess on said mandrel, said removable member extending into said recess and remaining in tact for said predetermined distance of movement in said first direction of said movable member.

13. The mechanism of claim 12, wherein;

said recess is occupied with a material to retard movement of said removable member in said recess.

14. The mechanism of claim 13, wherein;

said lock further selectively prevents movement of said movable member is said second direction until a sufficient amount of movement of said movable member in said first direction has occurred.

15. The mechanism of claim 14, wherein;

said movable member moves sufficiently in said first direction to defeat said removable member, whereupon removal of pressure through said port allows movement in said second direction until said port is exposed.

16. The mechanism of claim 15, wherein;

said lock comprising a split ring and said mandrel comprising a groove, whereupon movement in said first direction by said movable member, said split ring snaps into said groove in said mandrel thereby permitting subsequent movement of said movable member in a second direction to expose said port.

17. The mechanism of claim 8, wherein;

said lock further selectively prevents movement of said movable member is said second direction until a sufficient amount of movement of said movable member in said first direction has occurred.

18. The mechanism of claim 17, wherein;

said movable member moves sufficiently in said first direction to defeat said removable member, whereupon removal of pressure through said port allows movement in said second direction until said port is exposed.

19. The mechanism of claim 18, wherein;

said lock comprising a split ring and said mandrel comprising a groove, whereupon movement in said first direction by said movable member, said split ring snaps into said groove in said mandrel thereby permitting subsequent movement of said movable member in a second direction to expose said port.

20. The mechanism of claim 10, wherein;

said dog is retained by a dog retainer connected to said mandrel limiting said dog to radial movement with respect to said mandrel;

said piston comprises a pin extending into a groove in said dog retainer to prevent movement of said piston in said second direction.

* * * * *